US006170914B1

(12) United States Patent
Chang

(10) Patent No.: US 6,170,914 B1
(45) Date of Patent: Jan. 9, 2001

(54) CHAIR HAVING SEAT ELEVATING DEVICE

(76) Inventor: Horng Jiun Chang, No. 26-23, Tien Chong Yiang Road, Yuan Lin Town, Chang Hua Hsien (TW)

( * ) Notice: Under 35 U.S.C. 154(b), the term of this patent shall be extended for 0 days.

(21) Appl. No.: 09/472,622

(22) Filed: Dec. 27, 1999

(51) Int. Cl.[7] ..... A47C 1/02
(52) U.S. Cl. ..... 297/339; 297/344.17
(58) Field of Search ..... 297/344.12, 344.15, 297/344.17, 344.18, 344.2, 339, 338, 337; 248/404, 405, 157, 188.2, 188.4

(56) References Cited

U.S. PATENT DOCUMENTS 3,923,280 * 12/1975 Good .
4,700,921 * 10/1987 Holbrook .
5,708,992 * 1/1998 Gobbers et al. .

FOREIGN PATENT DOCUMENTS

1929413 * 12/1970 (DE) .
4300738 * 10/1992 (JP) .

* cited by examiner

*Primary Examiner*—Milton Nelson, Jr.
(74) *Attorney, Agent, or Firm*—Charles E. Baxley

(57) ABSTRACT

A chair includes a base and a seat each having two side tracks and a front track. Three pairs of pivotal bars have upper ends coupled to the tracks of the seat and have lower ends coupled to the tracks of the base. The bars may expand and fold when the seat moves up and down relative to the base. A tube is extended in the base, the seat includes a downward extending rod slidably engaging in the tube and threaded with a bolt. A motor is coupled to the bolt for driving the bolt and for moving the seat up and down relative to the base to adjust the height of the seat relative to the base.

6 Claims, 5 Drawing Sheets

CHAIR HAVING SEAT ELEVATING DEVICE

BACKGROUND OF THE INVENTION

1. Field of the Invention

The present invention relates to a chair, and more particularly to a chair having an elevating device for elevating the seat relative to a base.

2. Description of the Prior Art

Typical chairs, particularly sofas, comprise a seat or seat cushion solidly supported on a base. The seat may not be adjusted relative to the base such that the seat may not be adjusted according to the sizes of the users.

The present invention has arisen to mitigate and/or obviate the afore-described disadvantages of the conventional chairs.

SUMMARY OF THE INVENTION

The primary objective of the present invention is to provide a chair including an elevating device for elevating a seat relative to a base according to the sizes of the users.

In accordance with one aspect of the invention, there is provided a chair comprising a base including two side portions and a front portion, the side portions of the base each including a track provided thereon, a seat provided above the base and including two side portions and a front portion, the side portions of the seat each including a track provided thereon, two follower devices each including a pair of bars pivotally secured together at a middle portion thereof and each having an upper end and a lower end, the upper ends of the bars being slidably coupled in the tracks of the seat, and the lower ends of the bars being slidably coupled in the tracks of the base, the bars being expanded and folded when the seat moves up and down relative to the base, and means for moving the seat up and down relative to the base.

The upper ends and the lower ends of the bars each includes a roller secured thereto, and the tracks each includes a groove formed therein for receiving the rollers respectively.

The moving means includes a tube provided in the base, a rod extended downward from the seat and slidably received in the tube and having an inner thread formed therein, a bolt rotatably received in the tube and threaded with the inner thread of the rod, and means for rotating the bolt to move the rod up and down relative to the tube. The base includes a gear rotatably supported therein, the bolt is secured to the gear and extended upward from the gear, the rotating means includes a motor having a pinion engaged with the gear for rotating the gear and the bolt.

A limiting device is further provided for limiting a relative movement between the rod and the tube. The tube includes a slot formed therein, the limiting means includes two microswitches secured to the tube, and an actuator secured to the rod and slidably received in the slot of the tube and engageable with the microswitches for limiting the relative movement between the rod and the tube.

The front portions of the base and of the seat each includes a front track provided thereon, the chair includes a pair of pivotal bars each having an upper end slidably coupled to the front track of the seat, and each having a lower end slidably coupled to the front track of the base.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
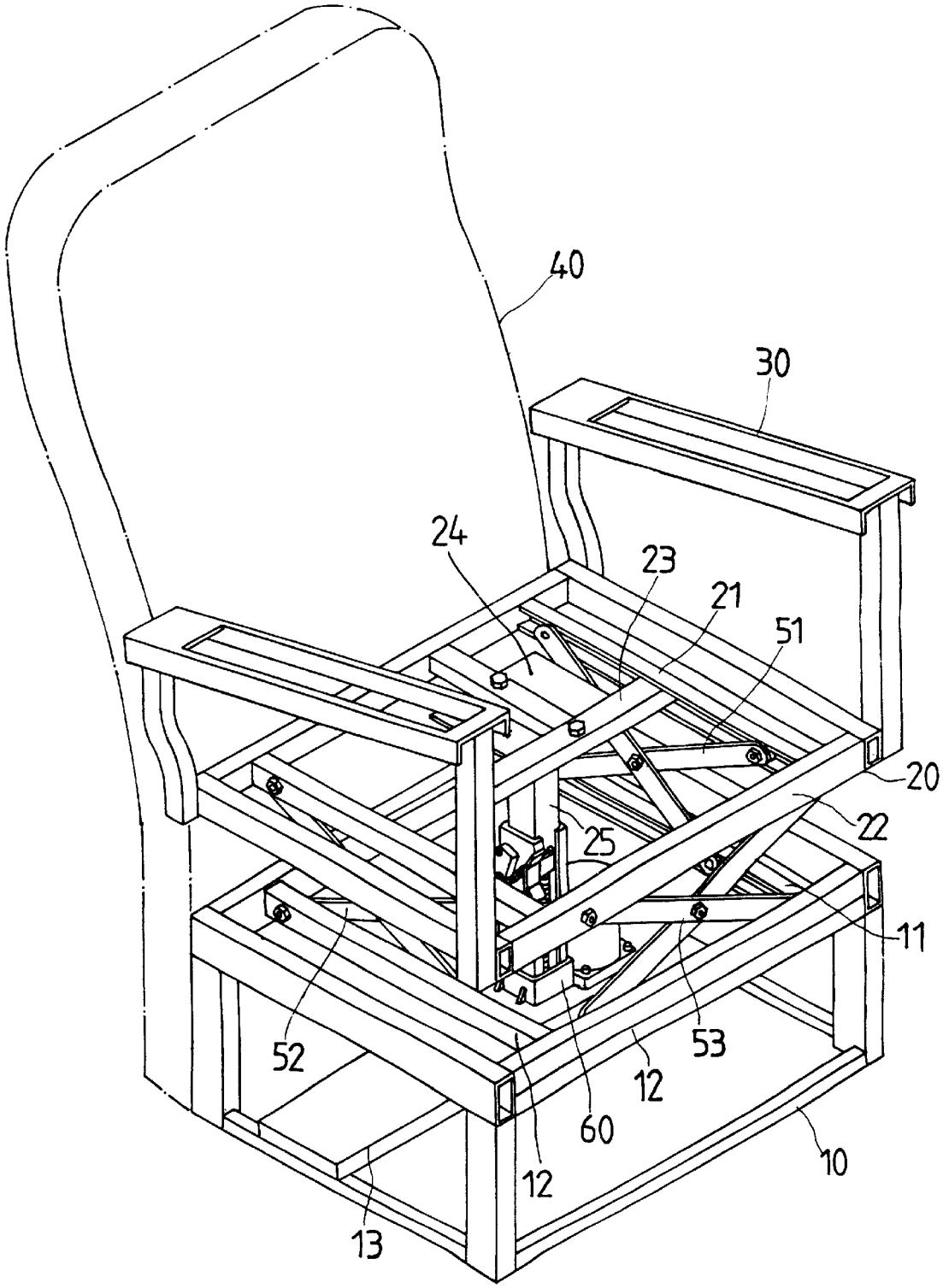
FIG. 1 is a perspective view of a chair in accordance with the present invention.
Figure 2:
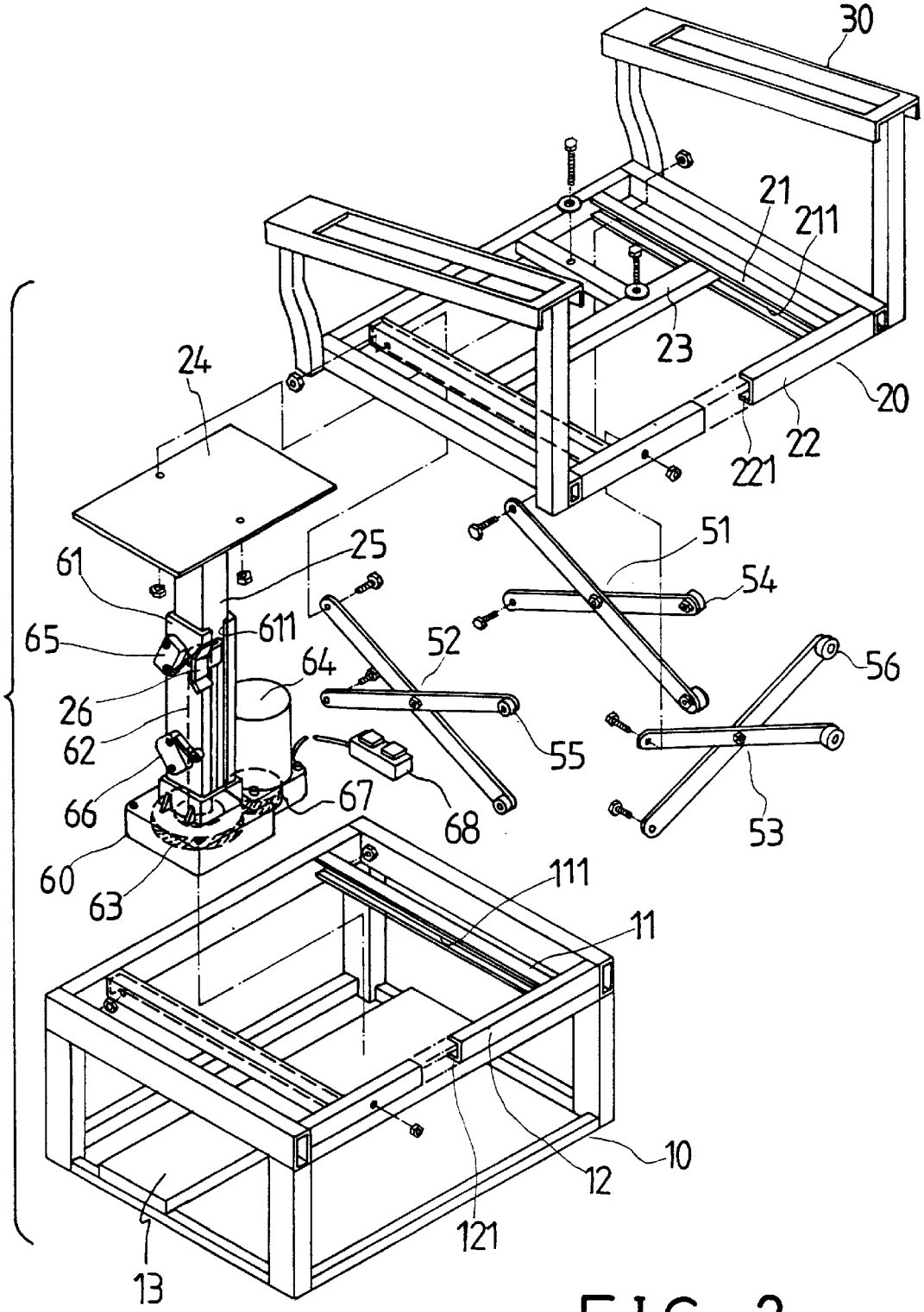
FIG. 2 is an exploded view of the chair.

Referring to the drawings, and initially to FIGS. 1–4, a chair in accordance with the present invention comprises a base 10 including a pair of opposite side tracks 11 and a front track 12 each having a groove 111, 121 formed therein. The base 10 includes a bottom plate 13 provided therein. Three follower devices each includes a pair of bars 51, 52, 53 pivotally secured together at the middle portion or at the middle pivot pin thereof for forming a portion of a lazy tongs device, and each includes four rollers or wheels 54, 55, 56 attached to the ends of the bars 51, 52, 53 respectively. The rollers 54, 55, 56 attached to the lower ends of the bars 51, 52, 53 are rotatably and slidably received in the grooves 111, 121 of the tracks 11, 12 respectively. A seat back 40 may be attached to the base 10 and/or the seat 20.

A seat 20 also includes a pair of opposite side tracks 21 and a front track 22, corresponding to that of the base 10 respectively, and each having a groove 211, 221 formed therein. The seat 20 preferably includes a pair of arm rests 30 provided thereon and provided on the side portions of the seat 20 and extended upward from the side portions of the seat 20. The rollers 54, 55, 56 attached to the upper ends of the bars 51, 52, 53 are rotatably and slidably received in the grooves 211, 221 of the tracks 21, 22 respectively. When the seat 20 is moved up and down relative to the base 10, the rollers 54, 55, 56 may slide along the tracks 11, 12, 21, 22 and the bars 51, 52, 53 of the three follower devices may rotated and folded or expanded relative to each other about the middle pivot pin thereof according to the movement of the seat 20 relative to the base 10. A board 24 is secured to the bottom of the seat 20 and includes a rod 25 extended downward therefrom.

A casing 60 is disposed on the bottom plate 13 of the base 10 for rotatably receiving a gear 63 therein, and includes a tube 61 extended upward therefrom. The tube 61 includes a longitudinal slot 611 formed therein. Two microswitches 65, 66 are attached to the side portion of the tube 61. A threaded rod or a bolt 62 is secured on the gear 63 and extended upward from the center of the gear 63 and rotatably received in the tube 61. The rod 25 is slidably engaged into the tube 61 and includes an inner thread 27 (FIG. 3) formed therein for threading with the bolt 62. An actuator 26 is secured to the rod 25 and moved in concert with the rod 25 and slidably engaged in the slot 611 of the tube 61 for engaging with either of the microswitches 65, 66 and for controlling and limiting the upward and downward movement of the rod 25 and the seat 20 relative to the base 10. A motor 64 may be secured to the tube 61 or the casing 60 or the bottom plate 13 of the base 10 and includes a pinion 67 attached to the spindle thereof and engaged with the gear 63 for driving the bolt 62 via the gear 63 and for moving the rod 25 and thus the seat 20 up and down relative to the base 10. A control device 68 may be provided for actuating the motor 64. The tube 61 and the rod 25 preferably include a non-circular cross section for preventing the rod 25 from rotating relative to the tube 61. The tube 61 and the rod 25 may also include a circular cross section due to the sliding engagement of the actuator 26 in the slot 611 of the tube 61.

Figure 3:
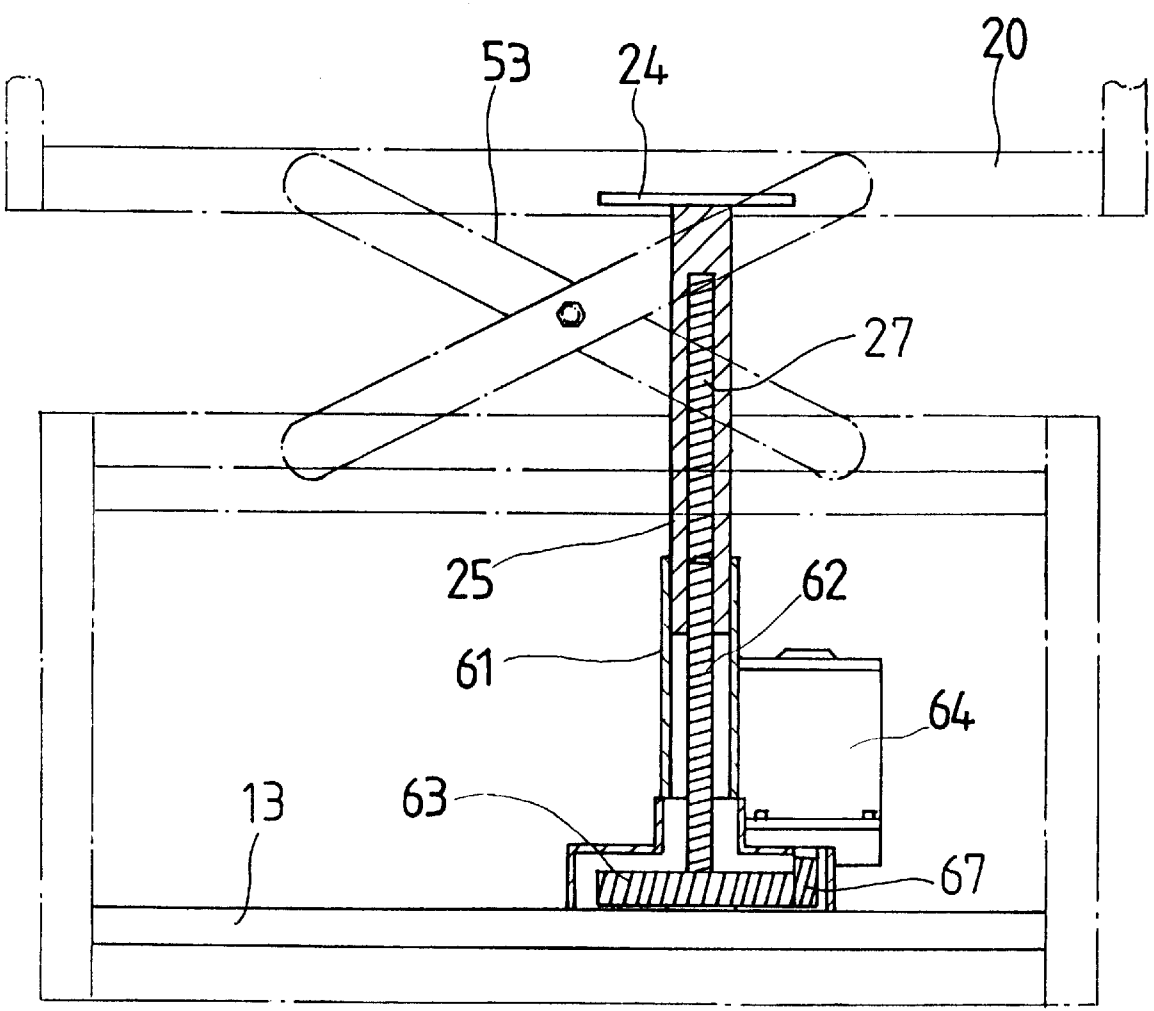
FIG. 3 is a partial cross sectional view of the chair.
Figure 4:
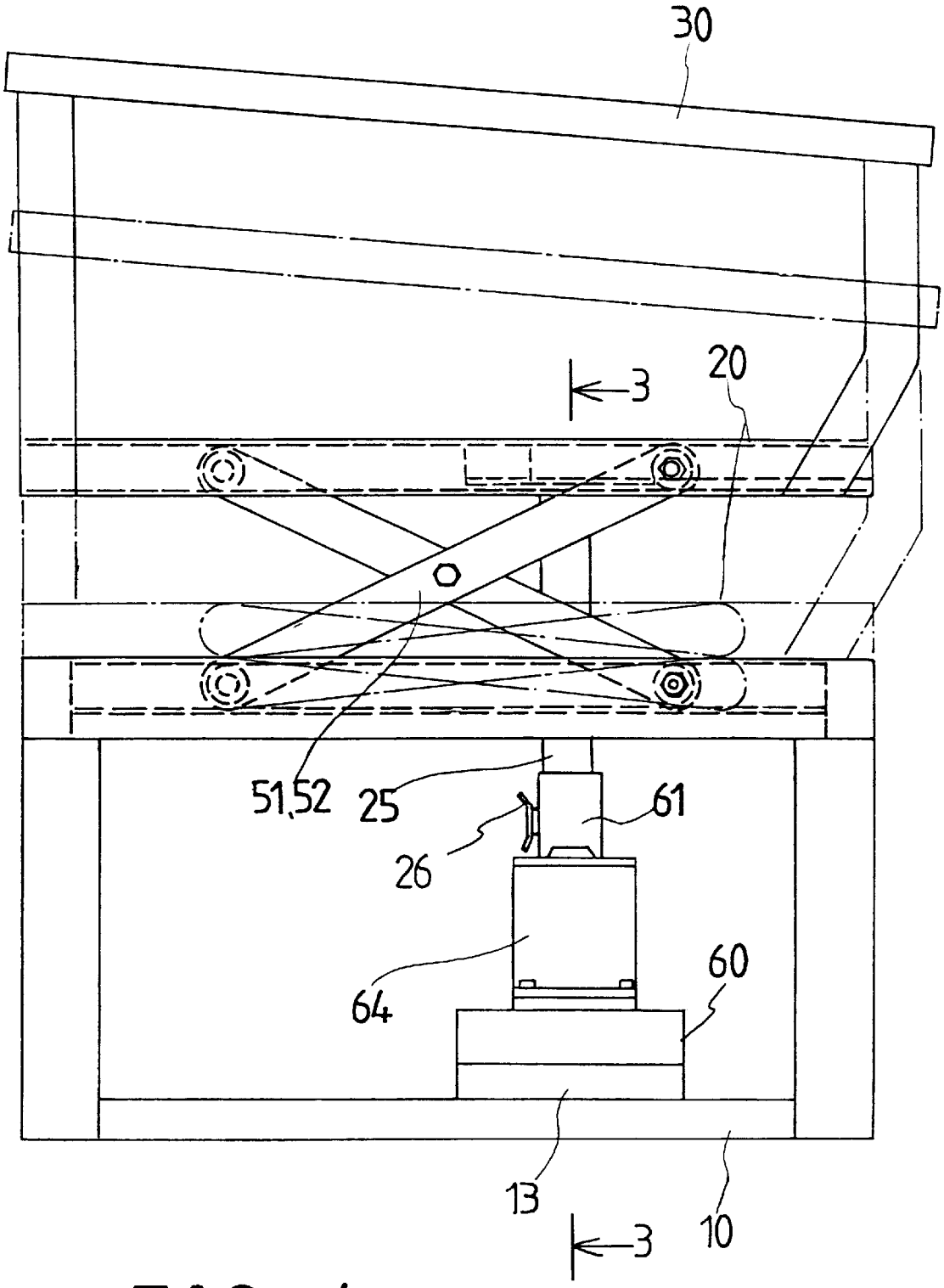
FIG. 4 is a side schematic view illustrating the operation of the chair.
Figure 5:
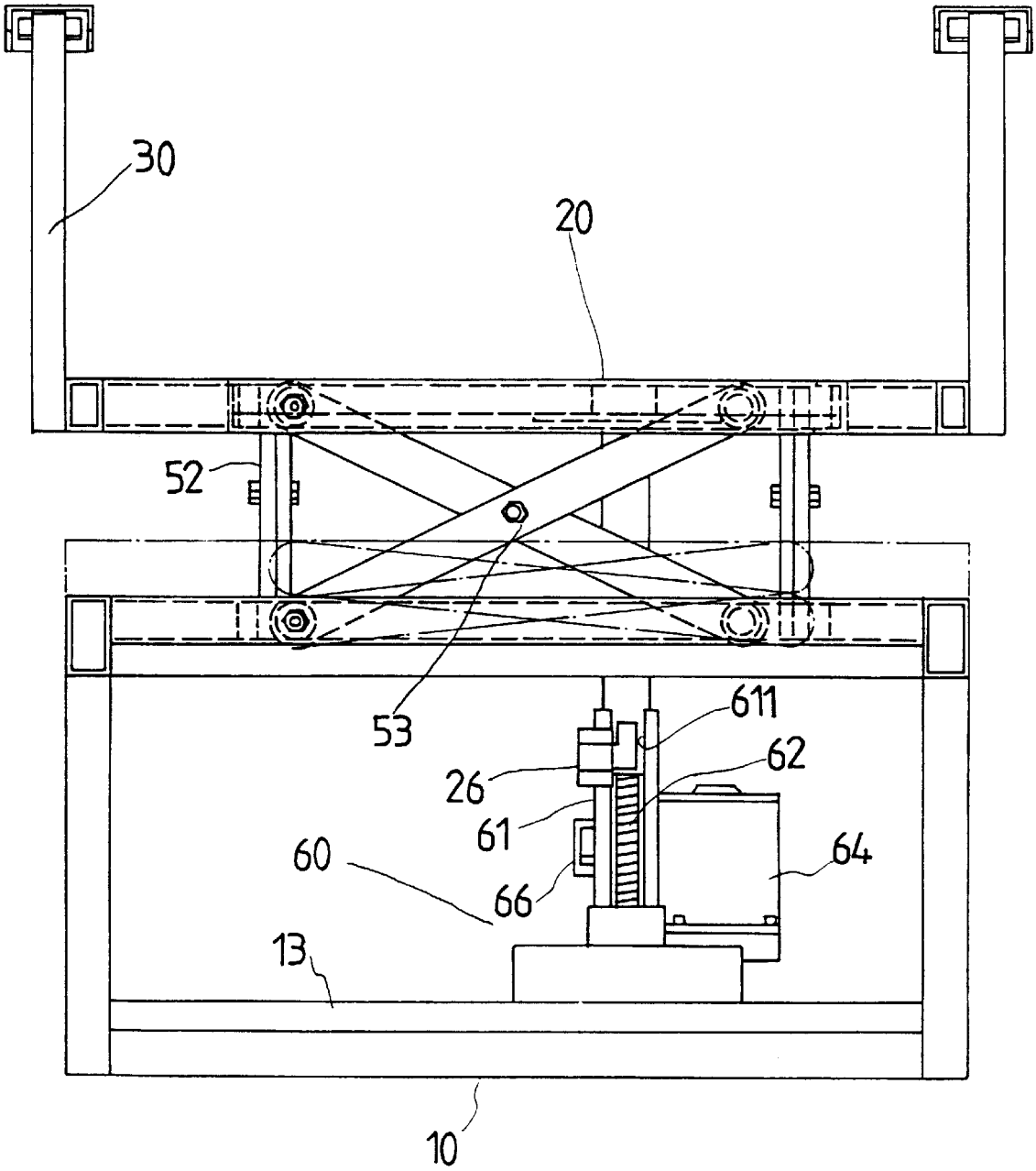
FIG. 5 is a front schematic view illustrating the operation of the chair.

In operation, as shown in FIGS. 3–5, the rod 25 may be moved up and down relative to the tube 61 when the bolt 62 and the gear 63 are rotated by the motor 64 via the pinion 67, such that the seat 20 may be micro-adjusted up and down relative to the base 10 by the motor 64. The control device 68 preferably includes two switches for controlling the first driving direction and the reverse driving direction of the motor 64, in order to move the rod 25 up and down relative to the tube 61. The engagement of the actuator 26 with either of the microswitches 65, 66 may limit the upward and downward movement of the rod 25 and the seat 20 relative to the base 10 and may prevent the rod 25 from being disengaged from the tube 61. The pairs of bars 51, 52, 53 may be folded and expanded according to the up and down movement of the seat 20 relative to the base 10.

Accordingly, the chair in accordance with the present invention includes an elevating device for elevating a seat relative to a base according to the sizes of the users.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A chair comprising:

a base including two side portions and a front portion, said side portions of said base each including a track provided thereon, a seat provided above said base and including two side portions and a front portion, said side portions of said seat each including a track provided thereon, two follower devices each including a pair of bars pivotally secured together at a middle portion thereof and each having an upper end and a lower end, one upper end of each pair of bars being slidably coupled in said tracks of said seat, and one lower end of each pair of bars being slidably coupled in said tracks of said base, said bars being expanded and folded when said seat moves up and down relative to said base, and means for moving said seat up and down relative to said base, said moving means including a tube provided in said base, a rod extended downward from said seat and slidably received in said tube and having an inner thread formed therein, a bolt rotatable received in said tube and threaded with said inner thread of said rod, and means for rotating said bolt to move said rod up and down relative to said tube.

2. The chair according to claim 1, wherein one upper end of each pair of bars includes a roller secured thereto, and said tracks each includes a groove formed therein for receiving said rollers respectively.

3. The chair according to claim 1, wherein said front portions of said base and of said seat each includes a front track provided thereon, said chair includes a pair of pivotal bars each having an upper end and a lower end, one upper end of said pair of pivotal bars is slidably coupled to said front track of said seat, and one lower end of said pair of pivotal bars is slidably coupled to said front track of said base.

4. The chair according to claim 1, wherein said base includes a gear rotatably supported therein, said bolt is secured to said gear and extended upward from said gear, said rotating means includes a motor having a pinion engaged with said gear for rotating said gear and said bolt.

5. The chair according to claim 1 further comprising means for limiting a relative movement between said rod and said tube.

6. The chair according to claim 5, wherein said tube includes a slot formed therein, said limiting means includes two microswitches secured to said tube, and an actuator secured to said rod and slidably received in said slot of said tube and engageable with said microswitches for limiting the relative movement between said rod and said tube.

* * * * *